US009595775B2

(12) United States Patent
Hanson

(10) Patent No.: US 9,595,775 B2
(45) Date of Patent: Mar. 14, 2017

(54) GROUNDING BLOCKS FOR WIRES/COAXIAL CABLES

(71) Applicant: PPC Broadband, Inc., East Syracuse, NY (US)

(72) Inventor: Brian K. Hanson, Cicero, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

(21) Appl. No.: 14/858,773

(22) Filed: Sep. 18, 2015

(65) Prior Publication Data

US 2016/0087354 A1 Mar. 24, 2016

Related U.S. Application Data

(60) Provisional application No. 62/052,055, filed on Sep. 18, 2014, provisional application No. 62/130,053, filed on Mar. 9, 2015.

(51) Int. Cl.

| | |
|---|---|
| ***H01R 4/66*** | (2006.01) |
| ***H01R 9/05*** | (2006.01) |
| ***H01R 4/42*** | (2006.01) |
| *H01R 13/655* | (2006.01) |

(52) U.S. Cl.

CPC ..... *H01R 9/0512* (2013.01); *H01R 4/42* (2013.01); *H01R 9/0503* (2013.01); *H01R 4/66* (2013.01); *H01R 13/655* (2013.01)

(58) Field of Classification Search

CPC ..... H01R 4/30; H01R 9/0512
USPC ..... 439/92, 97, 100, 806, 807, 801
See application file for complete search history.

(56) References Cited

U.S. PATENT DOCUMENTS

| | | | | |
|---|---|---|---|---|
| 4,502,743 A * | 3/1985 | Ziegler | ..... | H01R 4/646 439/98 |
| 4,784,621 A * | 11/1988 | Auclair | ..... | H01R 4/643 439/793 |
| 9,065,191 B2 * | 6/2015 | Martin | ..... | H01R 4/26 |

* cited by examiner

*Primary Examiner* — Phuong Dinh
(74) *Attorney, Agent, or Firm* — Oliff PLC

(57) ABSTRACT

A grounding block includes a conductive grounding surface configured to electrically ground a wire to a grounded structure, a retention member rotationally fixed about an axis orthogonal to the grounding surface and slidable toward and away from the conductive grounding surface in a direction parallel to the axis, and a biasing element configured to apply a first force to the retention member in the direction toward the conductive grounding surface to electrically ground the wire to the housing to satisfy a first regulatory requirement. A fastener is operative to apply a second force to the retention member in the direction toward the grounding surface to apply a mechanical load to satisfy a second regulatory requirement.

20 Claims, 7 Drawing Sheets

GROUNDING BLOCKS FOR WIRES/COAXIAL CABLES

CROSS-REFERENCE TO RELATED APPLICATIONS

This application is a non-provisional application that claims the benefits of priority of U.S. Provisional Application No. 62/052,055, filed on Sep. 18, 2014, and U.S. Provisional Application No. 62/130,053, filed on Mar. 9, 2015, the disclosures of which is incorporated herein by reference in their entirety.

BACKGROUND

Wire cables carry audio and/or video signals for radios, televisions and other telecommunications devices. A variety of cables, including Coaxial (Coax), High Definition Multimedia Interface (HDMI), Digital Video Interface (DGI), Video Graphics Array/Adapter (VGA), and Separation Video (S-Video) cables, may be used to transmit data, i.e., the audio/video signals, while power, in the form of alternating or direct current, may also be conducted along with, or through, the same or adjacent wire cables.

A signal carrying cable generally refers to a collection of two or more wires or conductors including a "hot" line to carry the current/signal, a "neutral" line to complete the current/signal carrying loop, and a "ground" line. Similarly, power cables include wires for negative, positive, and ground. The ground wire serves to protect a user during wire/cable installation and/or prevent damage to interconnected wires/cables during a high voltage/over-current condition. Such high voltage/over-current conditions may be produced by a power surge or a lightning strike.

A ground wire is typically connected to a highly conductive metal structure buried into the ground such as, for example, a copper water main of a residential or commercial building. While the electrical and mechanical connection from the wire/cable to ground is seemingly simple/non-complex, the requirements can be difficult to achieve. For example, a grounding connection between a coaxial cable and ground must pass an over-current condition of one-thousand five hundred and fifty Amperes (1550 Amps.) for six seconds (6.0 sec.) while maintaining electrical integrity to meet the requirements of Underwriters Laboratories (UL). During the electrical test, the connection must carry a load of one-hundred pounds (100 lbs.) for one hour. Meeting both the electrical and mechanical requirements is especially challenging when considering the need to minimize weight and cost. That is, there is constant pressure to reduce the thickness, and consequently, the weight and cost of wire/cables. The foregoing describes some, but not necessarily all, of the problems, disadvantages and challenges related to ground/bonding blocks.

SUMMARY

According to various aspects of the disclosure, a grounding block includes a conductive grounding surface configured to electrically ground a wire to a grounded structure, a retention member rotationally fixed about an axis orthogonal to the grounding surface and slidable toward and away from the conductive grounding surface in a direction parallel to the axis, and a biasing element configured to apply a first force to the retention member in the direction toward the conductive grounding surface to electrically ground the wire to the housing to satisfy a first regulatory requirement. A fastener is operative to apply a second force to the retention member in the direction toward the grounding surface to apply a mechanical load to satisfy a second regulatory requirement In accordance with various aspects, a grounding block includes a conductive housing having a cavity defined by a plurality of internal walls, a first wall of the plurality of internal walls defining a first aperture for receiving a ground wire electrically coupled to a grounding surface, and a second wall of the plurality of walls defining a second aperture and the grounding surface. The grounding surface is configured to electrically contact the ground wire. The grounding block includes a retention block disposed within the cavity of the housing and being configured to be slid toward and away from the grounding surface, a biasing element configured to urge the retention block toward the grounding surface such that a first force is developed between the ground wire and the housing, and a fastener threadably engaging the retention block such that a second force is selectively developed between the ground wire and the housing.

In some aspects, a grounding block for grounding a coaxial cable to a grounding surface includes a conductive housing having an input port configured to receive an upstream end of a cable and an output port configured to receive a downstream end of the cable, the conductive housing having a cavity defined by a plurality of internal walls. The plurality of internal walls include a first wall of the plurality of internal walls defining a first aperture for receiving a ground wire, and a second wall of the plurality of internal walls defining a second aperture and a grounding surface, the grounding surface being configured to electrically contact the ground wire. The grounding block includes a retention block disposed within the cavity of the housing, the retention block being rotationally coupled about an axis orthogonal to the grounding surface and slidable toward and away from the grounding surface in a direction parallel to the axis, a biasing element configured to urge the retention block toward the grounding surface such that a first force is developed between the ground wire and the conductive housing, and a fastener disposed through the second aperture and threadably engaging the retention block, the fastener being selectively rotatable relative to the retention block to develop a second force between the ground wire and the housing upon rotation of the fastener. The first threshold force satisfies an electrical grounding requirement of the grounding block, and the second threshold force satisfies a mechanical loading requirement in addition to the electrical grounding requirement.

BRIEF DESCRIPTION OF THE DRAWINGS

Features and advantages of the present disclosure are described in, and will be apparent from, the following Brief Description of the Drawings and Detailed Description.

DETAILED DESCRIPTION

Figure 1:
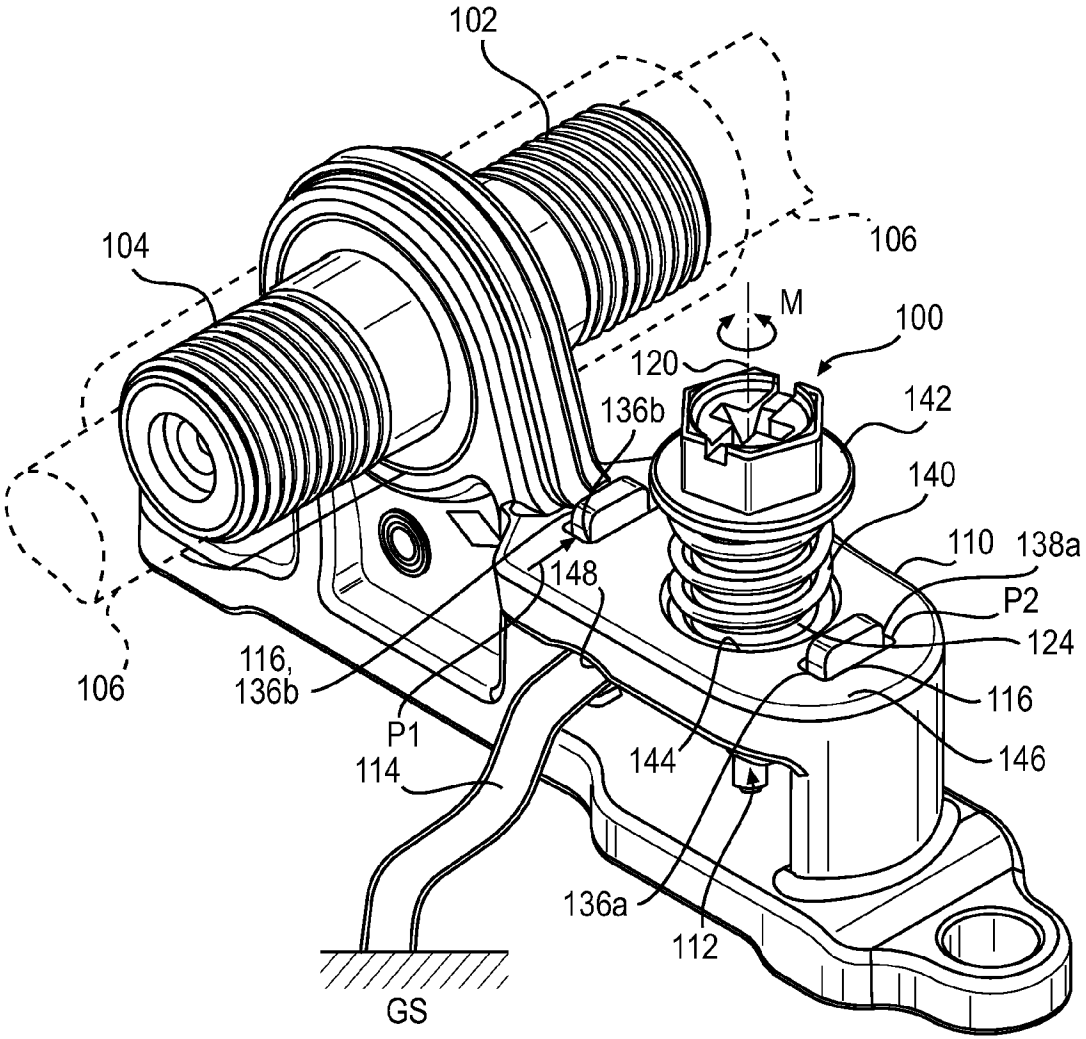
FIG. 1 is a perspective view of an exemplary grounding block according to one embodiment of the present disclosure.
Figure 2:
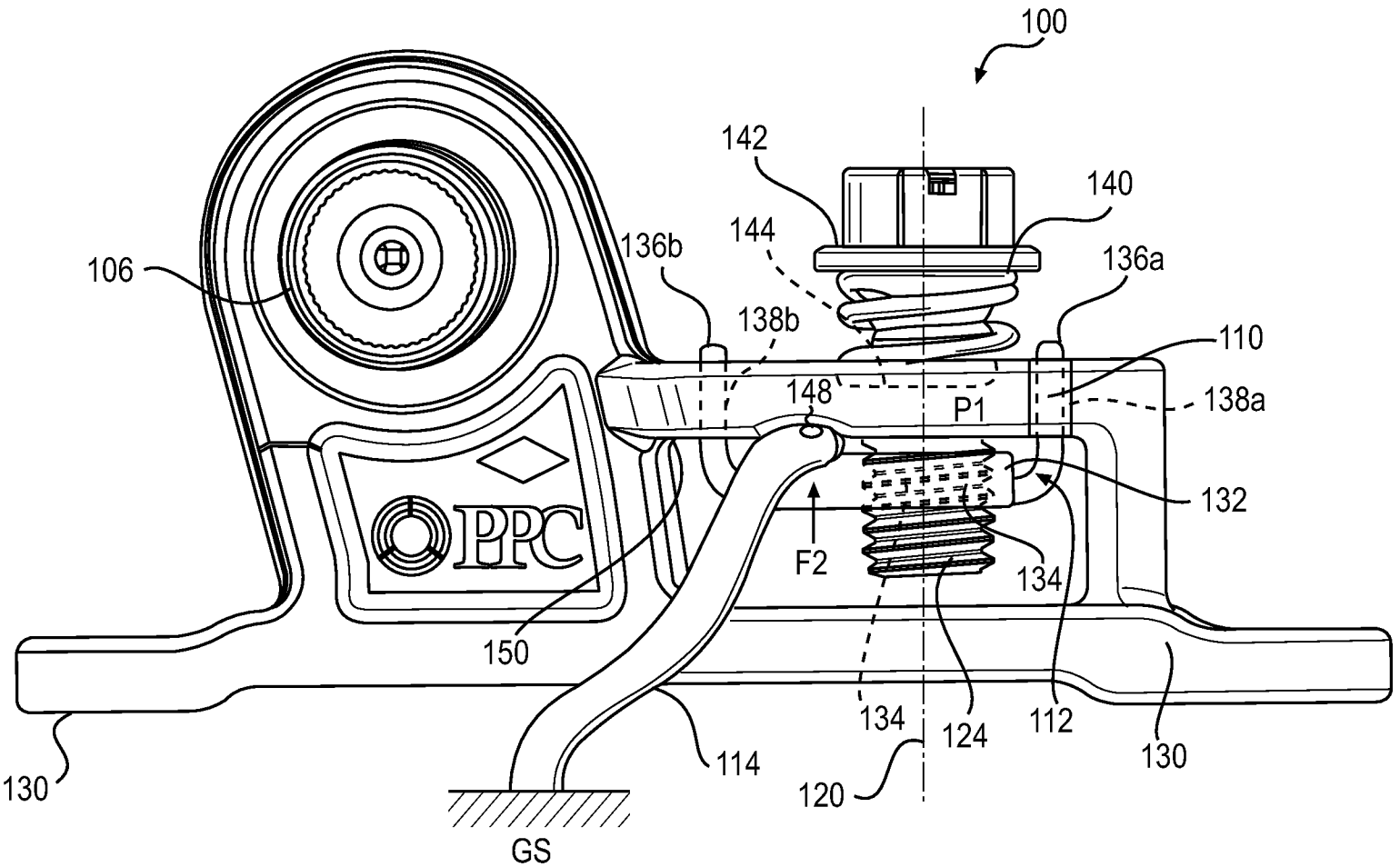
FIG. 2 is a side view of the grounding block of FIG. 1 while in a first operating position or mode wherein a first threshold level is achieved by a spring biasing element urging the ground wire against the underside of the bridge structure.
Figure 3:
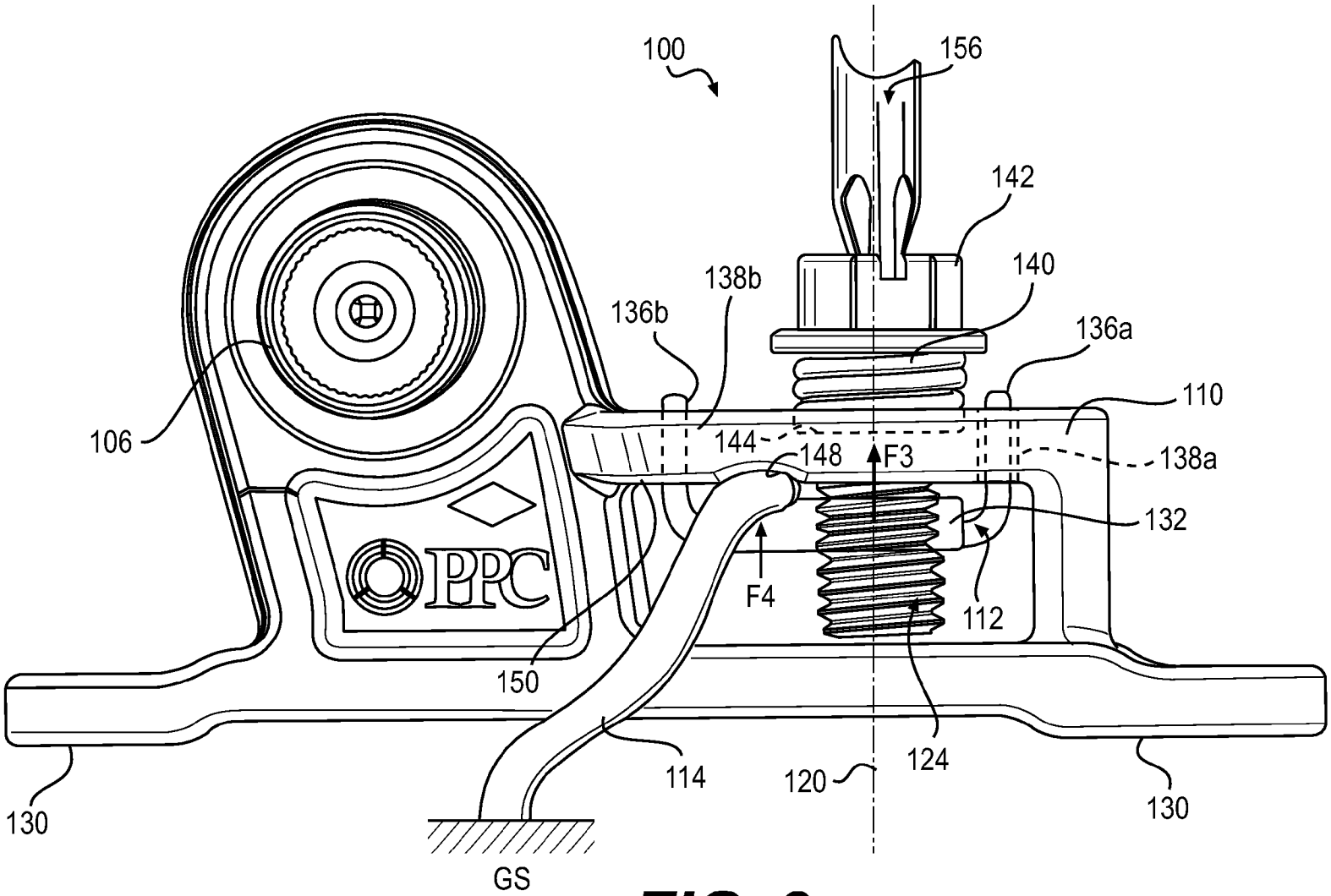
FIG. 3 is a side view of the grounding block of FIG. 1 while in a second operating position or mode wherein a second threshold level, substantially higher than the first threshold level, is achieved by a threaded fastener for drawing the retention clip into engagement with the ground wire and the bridge structure.
Figure 4:
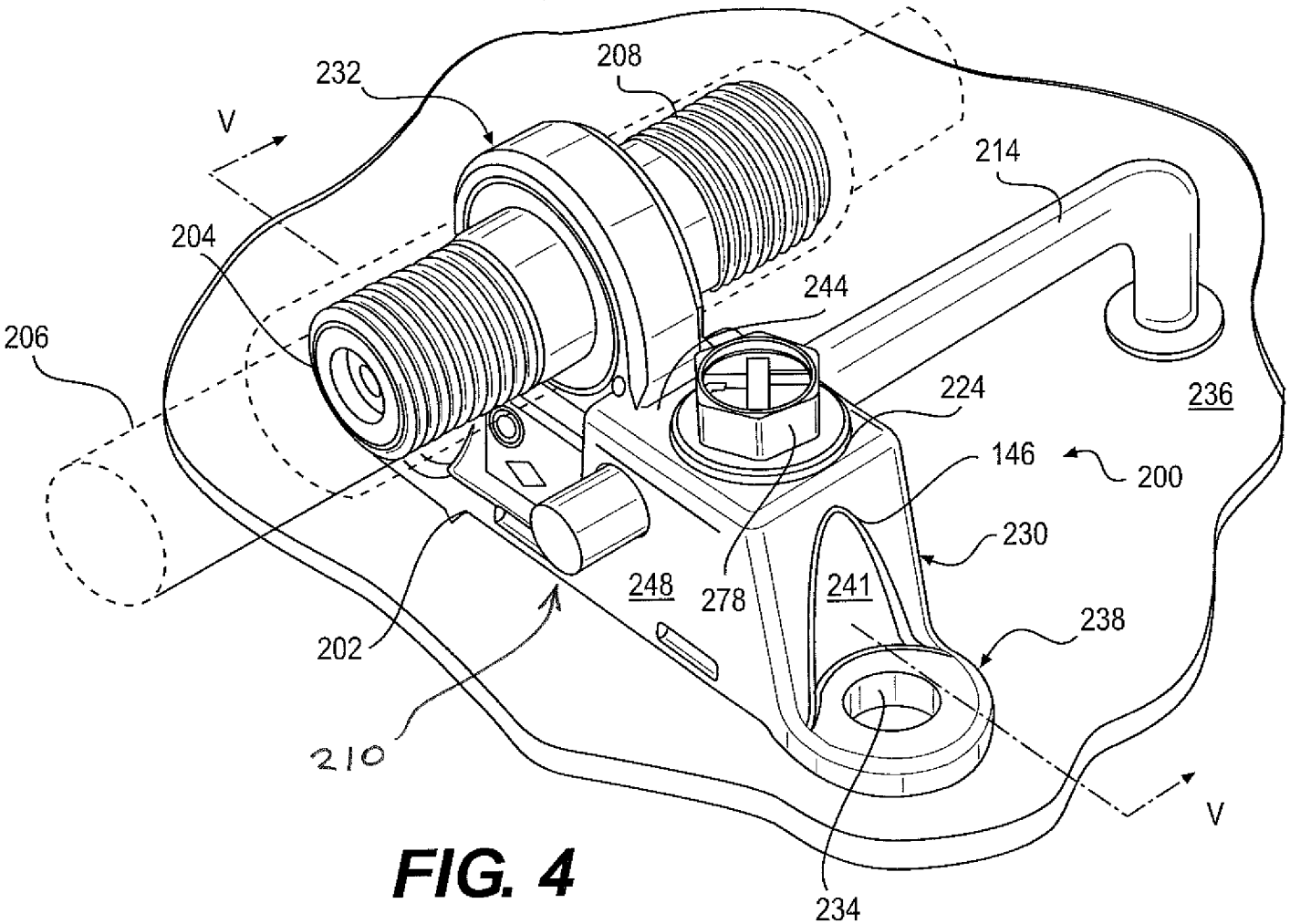
FIG. 4 is a perspective view of an exemplary grounding block according to an embodiment of the present disclosure.

FIGS. 1-3 illustrate a first embodiment of an exemplary grounding block 100 in accordance with various aspects of the disclosure. The grounding block 100 is configured to reliably connect a wire/cable to an electrically grounded structure. The grounding block 100 includes an input port 102, an output port 104, and a bridge 110. The input port 102 is configured to receive a prepared end of an upstream run of wire/coaxial cable 106, and the output port 104 is configured to receive a prepared end of a downstream run of wire/coaxial cable 106. Of course, in some embodiments, the input and output ports 102, 104 and the upstream and downstream runs of wire/coaxial cable 106 may be reversed.

The bridge 110 is electrically coupled to the input and output ports 102, 104. In the described exemplary embodiment, the bridge 110 is L-shaped and is electrically connected to an integration plate 126 and to a base plate 128. It should be appreciated that the integration plate 126 may be integral with the base plate 128 and is orthogonal to a mounting surface 130 of the base plate 128. The bridge 110, integration plate 126, and base plate 128 may be machined, molded, or otherwise fabricated from a conductive material such as, for example, copper, brass, steel, iron, or the like.

The grounding block 100 includes a retention clip 112 configured to cooperate with the bridge 110 to effect an electrical connection between the bridge 110 and a ground wire 114. In the described exemplary embodiment, the retention clip 112 is U-shaped and includes a web 132 and a pair of legs 136*a*, 136*b* extending from opposite ends of the web 132. The web 132 has a threaded aperture 134 for receiving a threaded fastener 124. The bridge 110 includes a pair of apertures 138*a*, 138*b* sized and arranged to receive the pair of legs 136*a*, 136*b* and define anti-torque surfaces 116 to prevent rotation of the retention clip 112 about an axis 120. While the clip 112 may be fabricated from any of a variety of non-conductive or non-ferrous materials, the retention clip 112 is fabricated from a conductive material including copper, brass, steel, iron, or the like.

The threaded fastener 124 extends through a bore 122 in the bridge 110 and into the threaded aperture 134 of the web 132. A biasing member 140, for example, a coil spring, is disposed between a head 142 of the fastener 124 and an upper surface 146 of the bridge 110. The coil spring 140 may be seated in a recess 144 of the bore 122. The coil spring 140 imposes an upward force F1 on the fastener 124 via the head 142, which, in turn, produces an upward force F2 on the retention clip 112 threadably coupled with the fastener 124.

When the ground wire 114 is disposed between the retention clip 112 and an underside 150 of the bridge 110, the upward force F2 urges the ground wire 114 against a recess 148 formed in the underside 150 of the bridge 110. The upward force F2 provides a first threshold contact force or pressure level (hereinafter "first threshold level") between the ground wire 114 and the bridge 110. The first threshold level is sufficient to produce an electrical ground path from the bridge 110 to the ground wire 114. The first threshold level is also sufficient to pass the electrical grounding test imposed by Underwriters Laboratory (UL), i.e., passing a current of one-thousand, five hundred and fifty amperes (1550 amps.) for six seconds (6.0 sec.), discussed above.

While a coil spring 140 is disposed between the head 142 of the fastener 124 and the recess 144 to achieve the first threshold level (i.e., the desired level of grounding contact) in the illustrated embodiment, it should be appreciated that other biasing elements are contemplated. For example, in some embodiments, a spring element, such as a cantilever, a washer, or a coil spring, disposed below the retention clip 112 may be employed to urge the retention clip 112 upwardly against the ground wire 114 and the bridge 110.

As will be discussed in greater detail below, the grounding performed by the spring-biased retention clip 112 occurs without further human intervention. That is, once the ground wire 114 is disposed between the retention clip 112 and the recess 148 in the underside 150 of the bridge 110, the wire/cable 106 is grounded by the coil spring 140 with a sufficient level of force/contact, i.e., the first threshold level, to allow the passage of a high current, i.e., 1550 amps., for a relatively long period of time, i.e., 6.0 sec.

The fastener 124 threadably engages the retention clip 112 along the axis 120 such that a second threshold contact force or pressure level (hereinafter "second threshold level") can be developed between the ground wire 114 and the bridge 110. The first threshold level satisfies an electrical grounding requirement, as discussed above, while the second threshold level satisfies a mechanical loading requirement in addition to the electrical grounding requirement.

The second threshold level is achieved by the same retention clip 112 as was discussed above in connection with the first threshold level. Furthermore, the ground wire 114 is disposed between the retention clip 112 and the bridge 110 in the same manner as described previously. The coil spring 140 also performs in the same manner, i.e., by raising the fastener 124 and retention clip 112 such that the ground wire 114 is urged into contact with the underside 150 of the bridge 110. The difference between the first and second threshold levels relates to a mechanical loading requirement which is satisfied in addition to the first electrical grounding requirement discussed above.

To achieve the mechanical loading requirement, the fastener 124 can be tightened or torqued, for example, by a conventional flat- or Phillips-head screw driver 156 or any tool capable of tightening or torqueing a fastener. The fastener 124 is tightened via rotation relative to the threadably coupled web 132 of the retention clip 112. Tightening of the fastener 124 compresses the coil spring 140 between the head 142 of the fastener 124 and the bridge 110 and, hence, increases the loads F3 and F4 (FIG. 3) applied to the retention clip 112 and the ground wire 114, respectively. As the head 142 of the fastener 124 rotates about the axis 120, a moment load M is imposed on the retention clip 112. The moment load M is reacted as a force couple P1, P2 along anti-torque surfaces 116 of the recesses 138*a*, 138*b* of the bridge 110. The load F4 imposed on the retention clip 112 by the threaded fastener 124 can be significantly higher than the load F2 imposed on the retention clip 112 solely by the coil spring 140. In the described embodiment, the second threshold level, i.e., the load imposed by the retention clip 112 is sufficient to carry a load of one-hundred pounds (100 lbs) for one hour (60 hr.) as the load is rotated in a circular pendulum.

The grounding block 100 of the present disclosure is configured to provide a level of assurance that a wire/cable will be properly grounded. This is accomplished by providing the grounding block 100 capable of achieving multiple thresholds or pressure levels, between the retention clip 112 and the ground wire 114. The first threshold level is achieved by a conventional spring-biased clip configured to trap at least one side of the ground wire 114 against a ground contact, that is, the bridge 110. The first threshold level is achieved without the need to dispense a particular level of force or torque through the grounding block 100. That is, once the ground wire 114 is properly placed between the retention clip 112 and the bridge 110, the coil spring 140 provides the requisite grounding force. The second threshold level is achieved by the threaded fastener 124 disposed in series with the coil spring 140. The second threshold level involves the requirement for a tool to impose the requisite grounding force.

When implementing both of the grounding methods, the grounding block 100 can satisfy a combination of electrical and mechanical requirements for wires/cables. The electrical requirement, which is of paramount importance for grounding wires/cables, can be met by a simple spring-loaded mechanism. The more rigorous mechanical requirement can be satisfied with the aid of a special tool. While both grounding steps should be implemented to optimally protect the devices serviced by the wire/cable, the grounding block 100 ensures that the electrical requirement will be achieved, even if the step of mechanically tightening the retention clip 112 is not performed and, consequently, the mechanical requirement is not met.

FIGS. 4-7 illustrate a second embodiment of an exemplary grounding block 200 in accordance with various aspects of the disclosure. The grounding block 200 is configured to reliably connect a wire/cable to an electrically grounded structure. The grounding block 200 includes a housing 210 having an input port 202 and an output port 204. The input port 202 is configured to receive a prepared end of an upstream run of wire/coaxial cable 206, and the output port 204 is configured to receive a prepared end of a downstream run of wire/coaxial cable 206. Of course, in some embodiments, the input and output ports 202, 204 and the upstream and downstream runs of wire/coaxial cable 206 may be reversed.

In the described embodiment, the housing 210 includes an integration plate 228, a rectangular body 230 integrated with, and projecting upwardly from, the integration plate 228, and a dorsal ring 232 integrated with an aft end of the rectangular body 230. The input and output ports 202, 204 extend away from one another on opposite sides of the dorsal ring 232. The integration plate 228 includes mounting apertures 234 for receiving fasteners (not shown) operative to attach the housing 210 to an electrically grounded plate or surface 236.

Figure 5:
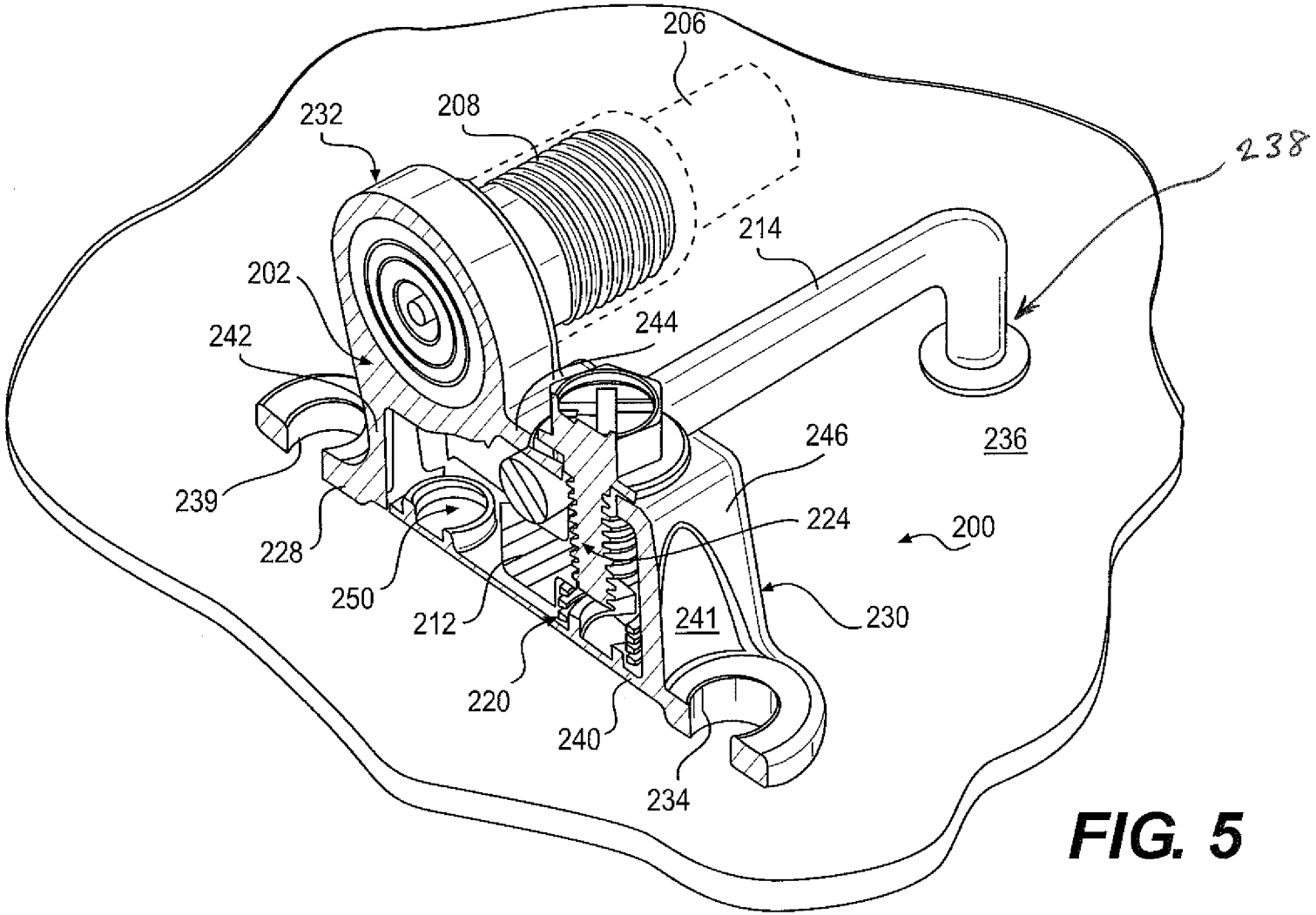
FIG. 5 is a sectional perspective view taken substantially along line V-V of FIG. 4 depicting the internal components of the grounding block.
Figure 6:
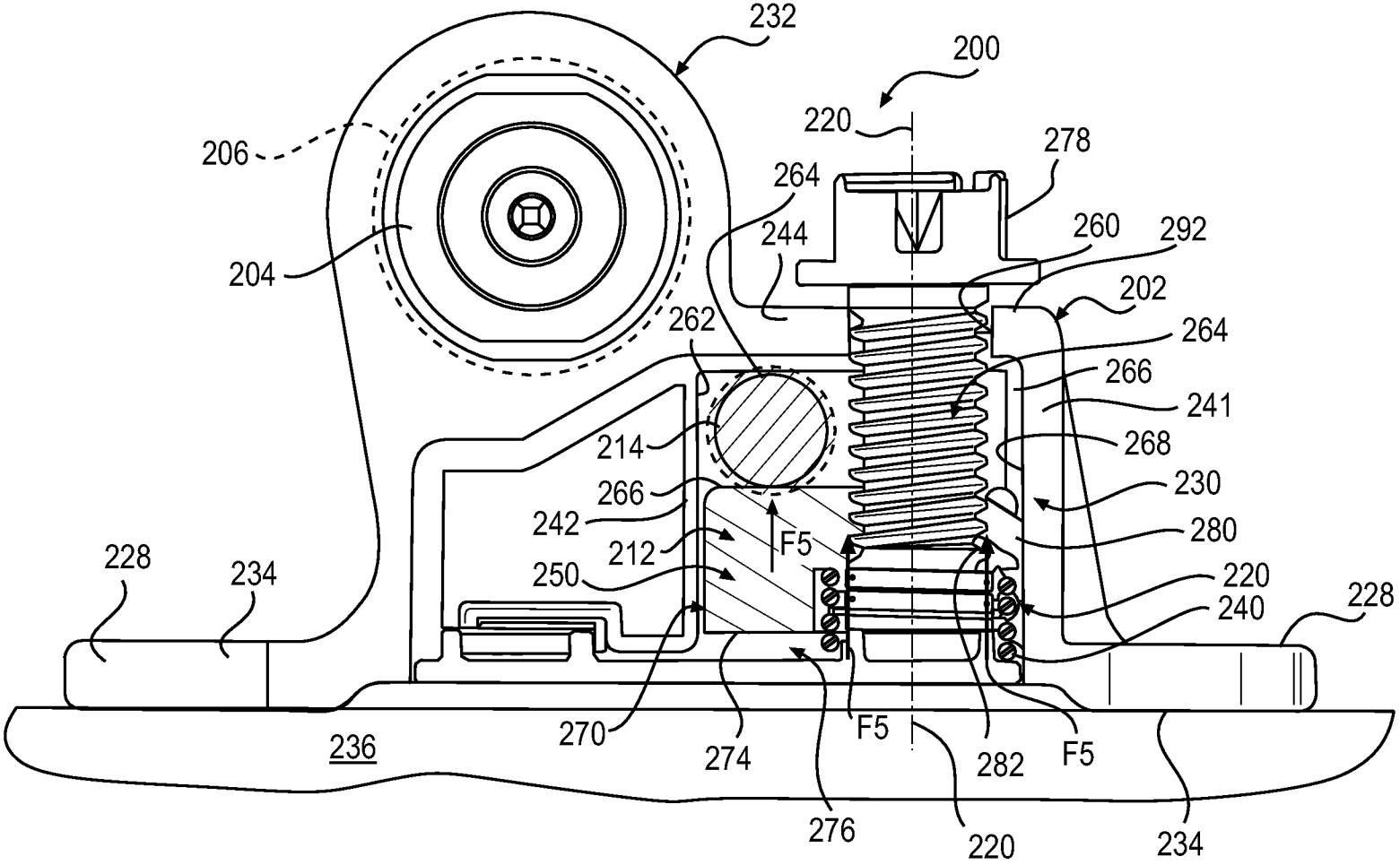
FIG. 6 is a side view of the grounding block of FIG. 4 while in a first operating position or mode wherein the biasing element produces a first contact force to urge the ground wire against the underside of the housing structure.
Figure 7:
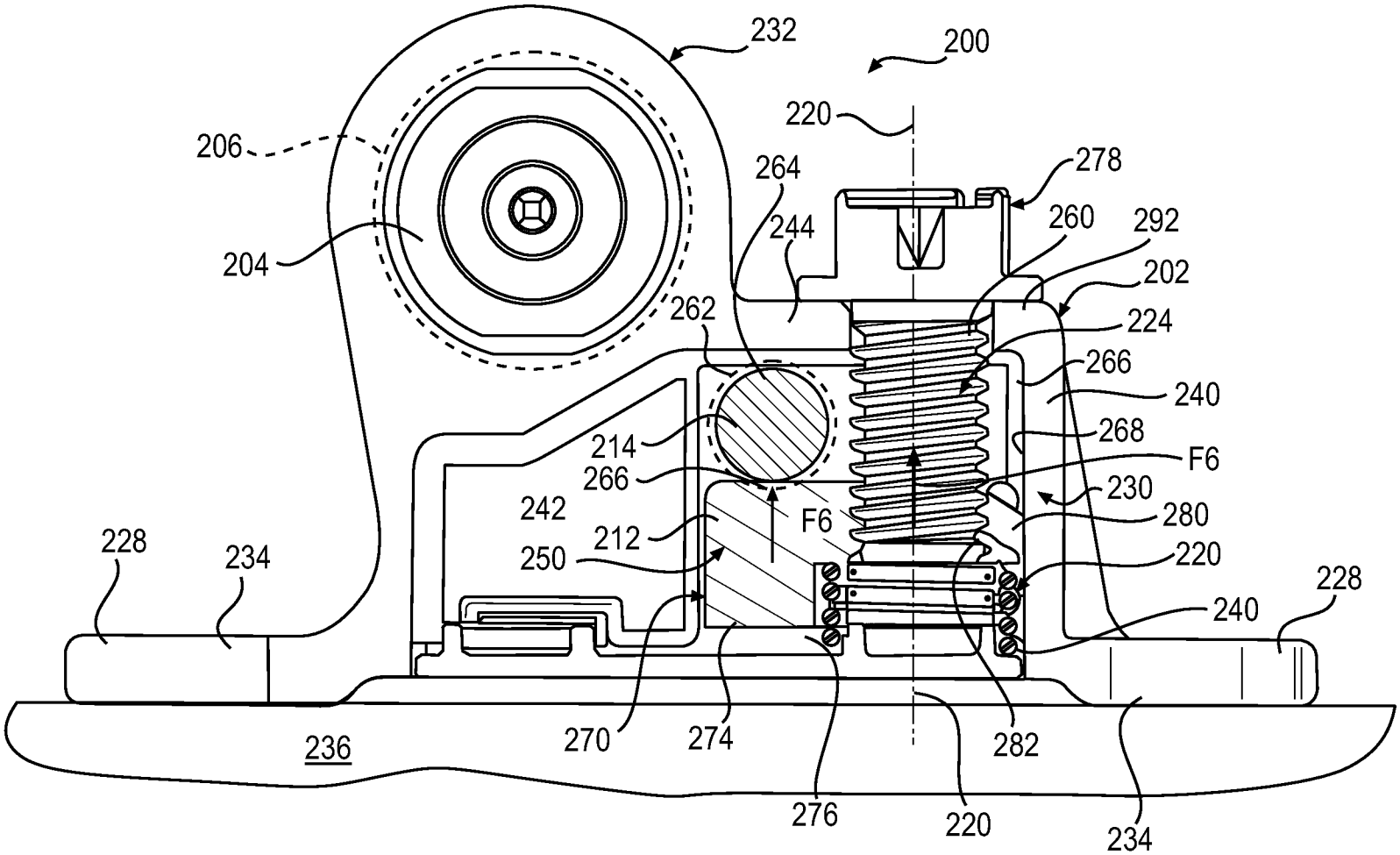
FIG. 7 is a view of the grounding block of FIG. 1 while in a second operating position or mode wherein the fastener produces a second contact force against the ground wire to urge the ground wire against the underside of the housing structure, the second level of contact force being greater than the first level of contact force.

Referring to FIGS. 5-7, the rectangular body 230 includes forward and aft support walls 241, 242, an upper wall 244 substantially parallel to the integration plate 228, and a pair of lateral sidewalls 246, 248 connecting to the support and upper walls 241, 242, 244. The walls 241, 242, 244, 246, 248 of the rectangular body 230 define an internal cavity 250 for receiving the retention block 212, the grounding wire 214, the biasing element 220 and the threaded fastener 224. More specifically, the upper wall 244 defines a first aperture 260 configured to receive the threaded fastener 224 while at least one of the sidewalls 246, 248 defines a second aperture 262 for receiving the ground wire 214. The first aperture 260 receives the threaded fastener 224 and has a diameter which exceeds the diameter of the threads to allow the fastener 224 to move freely, in either direction, through the aperture 260. The second aperture 262 receives the ground wire 214 and aligns with an underside surface 264 of the upper wall 244 such that a force pressing the ground wire 214 against the underside surface 264 does not bend, shear or kink the ground wire 214.

The dorsal ring 232 is integrated with the aft support and upper walls 242, 244 of the body 230 and is substantially parallel to the sidewalls 246, 248 thereof. Structurally, the dorsal ring 232 mounts each of the input and output interface ports 204, 208 such that an electrical ground path is produced between the grounding conductor within the coaxial cable 206 and the rectangular body 230 of the housing 210.

The housing 210 defines a cavity 250 that contains a retention block 212. The retention block 212 cooperates with the housing 210 to effect an electrical connection between the grounding plate 236 and the ground wire 214. The described embodiment shows the grounding wire 214 extending from the body 230 through an aperture 238 of the grounding plate 236. However, it should be appreciated that the grounding wire 214 may be attached to the grounding plate 236 by any of a variety of methods including welding, soldering, clamping, or the like.

The biasing element 244 is operative to urge the retention block 212 toward the housing 210 such that the first threshold level may be developed between the ground wire 214 and the grounding surface 236 of the housing 210. The retention block 212 resembles a shoe having a heal portion 270 and a forward sole portion 280. The heal 270 defines a contoured upper surface 272, and the forward sole 280 defines a threaded aperture 282. The heal 270 is aligned with the second aperture 262 of the sidewall 246 to engage the ground wire 214 while the sole 280 is aligned with the first aperture 260 to engage the threaded fastener 224. The upper surface 272 of the heal 270 is contoured to compliment the peripheral surface of the ground wire 214 when compressed against the underside surface 264 (i.e., a grounding or conductive surface) of the upper wall 244. A lower surface 274 of the heal 270 abuts a removable portion 276 of the integration plate 228 which closes the cavity 250 of the housing 210. The lower abutment surface 274 limits the downward motion of the retention block 212 when an operator depresses a head 278, for example, a hexed-shaped head, of the fastener 224 to insert the ground wire 214 into the second aperture 262. These operating modes will be discussed when describing the operation of the grounding block 200 with respect to FIGS. 6 and 7 below.

In the described embodiment, the biasing element 244 is a coil spring disposed between the removable portion 276 of the integration plate 228 and the sole 280 of the retention block 212. As such, the coil spring 240 biases the retention block 212 upwardly, to capture the ground wire 214 when it is insert through the second aperture 262 of the body 230, between the contoured upper surface 272 of the retention block 212 and the underside surface 264 of the housing 210. The coil spring 240 imposes an upward force F5 on the fastener 224 which, in turn, produces an equal or substantially equivalent, upward force F5 on the retention block 212. The upward force F5 urges the ground wire 214 against the underside surface 264 of the body 230 at least at the first threshold level. In the described embodiment, the first threshold level is sufficient to produce an electrical ground path from the housing 210 to the ground wire 214. This threshold level is also sufficient to pass the electrical grounding test imposed by Underwriters Laboratory (UL), i.e., passing a current of one-thousand, five hundred and fifty Amperes (1550 amps.) for six seconds (6.0 sec.), as discussed above.

While the first threshold level is achieved by the coil spring 240, it should be appreciated that other biasing elements are contemplated. For example, a cantilever, washer, or coil spring, may be employed beneath the retention block 212 to apply the first force F5 to the ground wire 214.

As will be discussed in greater detail below, the grounding performed by the spring-biased retention block 212 occurs without further human intervention. That is, once the ground wire 214 is disposed between the retention block 212 and the upper wall 244 of the housing 210, the wire/cables 206 are grounded by the coil spring 240 to allow a high current/over-current condition, i.e., 1550 A for 6.0 seconds.

As best illustrated in FIGS. 6 and 7, the retention block 212 extends in a direction parallel to a rotation axis 220 of the fastener 224. The retention block 212 is disposed within the cavity 250 of the housing 210 and is operative to slide vertically up and down in the direction parallel to the rotational axis 220 of the fastener 224. Furthermore, a surface 266 of the cavity prevents rotation of the block 212 about and about the rotational axis 224 of the fastener 224. More specifically, the retention block 212 engages at least one vertical guide rail 266 disposed along an internal surface 268 of at least one of the forward and aft walls 241, 242. As such, the vertical guide rail 266 facilitates vertical translation while preventing rotation of the retention block 212 about the rotational axis 220 of the fastener 224.

The fastener 224 threadably engaging the retention block 212 such that a second contact pressure or force F6 may be developed between the ground wire 214 and the housing 210. The first threshold level satisfies an electrical grounding requirement while the second force F6 meets or exceeds the second threshold level, which satisfies a mechanical loading requirement in addition to the electrical grounding requirement.

A second force F6, between the ground wire 214 and the housing 210, is achieved by the same retention block 212 as was discussed above in connection with the first threshold level. Furthermore, the ground wire 214 is disposed between the retention block 212 and the housing 210 in the same manner as described previously. The coil spring 240 also performs in the same manner, i.e., by lifting or raising the fastener 224 and retention block 212 such that the ground wire 214 is urged into contact with the underside 244 of the housing 210.

The second threshold level, and thus the second force F6, is higher than the first threshold level and the first upward force F5. The second force F6 is achieved by turning the threaded fastener 224 until the hex-shaped head 278 seats against or contacts the upper wall surface 292 of the housing 210. The difference between the first and second threshold F5, F6 generally relates to the second mechanical loading requirement which is satisfied in addition to the first electrical grounding requirement discussed above. To achieve the mechanical loading requirement, the fastener 224 is tightened or torqued (i.e., by a conventional flat- or Phillips-head screw driver or any tool capable of tightening or torqueing a fastener) to increase the force couple produced between the sole 280 and heal 270 of the retention block 212. As the head 278 of the fastener 224 rotates about the fastener axis 220, the second force F6 is produced along the fastener axis 220 which, in turn, produces an equal or substantially equivalent second force F6 on the retention block 212. The second threshold force F6 imposed on the retention block 212 by the threaded fastener 224 can be significantly higher than the first force F5 imposed on the retention block 212 by the coil spring 240. In the described embodiment, the second threshold level, i.e., the force imposed by the retention block 212, is sufficient to carry a load of one-hundred pounds (100 lbs.) for one hour (60 hr.) as the load is rotated in a pendulum-like circular path.

The grounding block 200 of the present disclosure is configured to provide a level of assurance that a wire/cable will be properly grounded. This is accomplished by providing a grounding block 200 capable of applying multiple force thresholds, between a retention block 212 and a ground wire 214. In FIG. 6, the first threshold level is achieved by a conventional spring-biasing element 220 to urge a ground wire 214 against the housing 210. The first threshold level is achieved without the need to dispense a particular level of force or torque through the grounding block 212. That is, once a ground wire 214 is properly placed between the retention block 212 and the housing 210, the spring biasing element 220 provides the requisite grounding force.

In FIG. 7, the second threshold level is achieved by the threaded fastener 224 which is disposed in parallel with the spring biasing element 220. The second threshold level involves the requirement for a tool to impose the requisite grounding force. In the described embodiment, the second force F6 is augmented or assisted by the physical displacement or position of the fastener 224 relative to the retention block 212. While the precise magnitude of force may be calibrated by a special tool such as a torque wrench, the embodiment of the present disclosure employs the position of the fastener head 278 relative to the upper wall 292 of the housing 210 to achieve the second force F6. That is, the thread pitch and the dimensions between the retention block 212 and the upper wall 264 of the housing 210 are selected such that a known force F6 may be applied by the retention block 212 to the ground wire 214.

When implementing both of the grounding methods, the grounding block 200 can satisfy a combination of electrical and mechanical requirements for wires/cables. The electrical requirement, which is of paramount importance for grounding wires/cables, can be met by a simple spring-loaded mechanism. The more rigorous mechanical requirement can be satisfied with the aid of a special tool and/or by preselecting dimensions between a threaded fastener 224 and retention block 212.

While both grounding steps should be implemented to optimally protect the devices serviced by the wire/cable, the grounding block 200 ensures that the electrical requirement will be achieved, even if the step of mechanically tightening the retention block 212 is not performed and, consequently, the mechanical requirement is not met.

In the described embodiment, the rotational position of the retention block 212 is fixed so that block 212 does not rotate about the fastener axis 220. While the block 212 is configured to slide along the vertical axis 220 of the fastener 224, it will be appreciated that the retention block 212 may slide laterally along a horizontal axis to capture a ground wire, i.e., apply first and second threshold forces, against one of the sidewall structures. In such an embodiment, the first and second apertures for receiving the ground wire 214 and fastener 224 would be reversed. That is, the first aperture for receiving the ground wire 214 would be in the upper wall and the second aperture for receiving the fastener 224 would be in one of the sidewalls.

According to various aspects, the input and output ports 102, 104, 202, 204 may be female interface ports including a stud or jack, such as a cylindrical stud, as illustrated in FIGS. 1-7. As would be understood by persons of ordinary skill in the art, the stud has: (a) an inner, cylindrical wall defining a central hole configured to receive an electrical contact, wire, pin, conductor (not shown) positioned within the central hole; (b) a conductive, threaded outer surface; (c) a conical conductive region having conductive contact sections and; and (d) a dielectric or insulation material.

In one embodiment, the stud of the input and output ports 102, 104, 202, 204 is shaped and sized to be compatible with the F-type coaxial connection standard. It should be understood that, depending upon the embodiment, stud could have a smooth outer surface. During installation, the installer couples the cable 106 to each of the input and output ports 102, 104, 202, 204 by screwing or pushing a connector (not shown in detail) onto the port. Once installed, the connector receives the female interface port. The connector establishes an electrical connection between the cable and the electrical contact of the female interface port. The input ports 102, 202 are also electrically coupled with the respective output ports 104, 204.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A grounding block, comprising:

a conductive grounding surface configured to electrically ground a wire to a grounded structure;

a retention member rotationally fixed about an axis orthogonal to the grounding surface and slideable toward and away from the conductive grounding surface in a direction parallel to the axis;

a biasing element configured to apply a first force to the retention member in the direction toward the conductive grounding surface to electrically ground the wire to the conductive grounding surface to satisfy a first regulatory requirement; and a fastener operative to apply a second force to the retention member in the direction toward the conductive grounding surface to apply a mechanical load to satisfy a second regulatory requirement.

2. The grounding block of claim 1, wherein the second force is greater than the first force.

3. The grounding block of claim 1, wherein the biasing element is a coil spring.

4. The grounding block of claim 1, wherein the conductive grounding surface is a bridge electrically coupled with an input port and an output port configured to receive ends of a cable.

5. The grounding block of claim 4, wherein the retention member is a retention clip configured to clamp the wire to the bridge.

6. The grounding block of claim 5, wherein the fastener extends through the bridge and is threadably received by the retention clip.

7. The grounding block of claim 6, wherein the biasing element is disposed between a surface of the bridge and a head of the fastener, the biasing element being configured to urge the head of the fastener away from the bridge.

8. The grounding block of claim 7, wherein the retention clip is configured to be urged toward the bridge by the biasing element as the head of the fastener is urged away from the bridge.

9. The grounding block of claim 8, wherein the fastener is selectively rotatable relative to the retention clip such that retention clip is slidably moved toward the conductive grounding surface to apply the second force when the retention clip is moved toward the head of the fastener.

10. The grounding block of claim 1, wherein the conductive grounding surface is a wall of a housing, the housing being electrically coupled with an input port and an output port configured to receive ends of a cable.

11. The grounding block of claim 10, wherein the retention member is a retention block configured to clamp the wire to the wall of the housing.

12. The grounding block of claim 11, wherein the fastener extends through an aperture in the wall of the housing and is threadably received by the retention block.

13. The grounding block of claim 12, wherein the biasing element is disposed between a second wall of the housing and the retention block, the biasing element being configured to urge the retention block toward the conductive grounding surface.

14. The grounding block of claim 13, wherein the retention block is configured to be urged toward the conductive grounding surface by the biasing element as the head of the fastener is urged away from the housing.

15. The grounding block of claim 14, wherein the fastener is selectively rotatable relative to the retention block such that retention block is moved toward the conductive grounding surface to apply the second force when the retention block is moved toward the head of the fastener.

16. A grounding block, comprising:

a conductive housing having a cavity defined by a plurality of walls;

a first wall of the plurality of walls defining a first aperture for receiving a ground wire electrically coupled to a grounding surface and a second wall of the plurality of walls defining a second aperture and the grounding surface, the grounding surface being configured to electrically contact the ground wire;

a retention block disposed within the cavity of the housing and being configured to be slid toward and away from the grounding surface;

a biasing element configured to urge the retention block toward the grounding surface such that a first force is developed between the ground wire and the housing, and a fastener threadably engaging the retention block such that a second force is selectively developed between the ground wire and the housing.

17. The grounding block of claim 16, wherein the second force is greater than the first force.

18. The grounding block of claim 16, wherein the biasing element is a coil spring.

19. A grounding block for grounding a coaxial cable to a grounding surface, comprising:

a conductive housing having an input port configured to receive an upstream end of a cable and an output port configured to receive a downstream end of the cable, the conductive housing having a cavity defined by a plurality of walls, the plurality of walls including a first wall of the plurality of walls defining a first aperture for receiving a ground wire, and a second wall of the plurality of walls defining a second aperture and a grounding surface, the grounding surface being configured to electrically contact the ground wire;

a retention block disposed within the cavity of the housing, the retention block being rotationally coupled about an axis orthogonal to the grounding surface and slideable toward and away from the grounding surface in a direction parallel to the axis;

a biasing element configured to urge the retention block toward the grounding surface such that a first force is developed between the ground wire and the conductive housing, and a fastener disposed through the second aperture and threadably engaging the retention block, the fastener being selectively rotatable relative to the retention block to develop a second force between the ground wire and the housing upon rotation of the fastener;

wherein the first threshold force satisfies an electrical grounding requirement of the grounding block, and wherein the second threshold force satisfies a mechanical loading requirement in addition to the electrical grounding requirement.

20. The grounding block of claim 19, wherein the biasing element is a coil spring.

* * * * *